United States Patent [19]

Wise

[11] Patent Number: 4,648,522

[45] Date of Patent: Mar. 10, 1987

[54] BARREL

[75] Inventor: Thomas W. Wise, Oreland, Pa.

[73] Assignee: Plastech International, Inc., Warminster, Pa.

[21] Appl. No.: 773,463

[22] Filed: Sep. 9, 1985

[51] Int. Cl.[4] ..... B65D 21/02

[52] U.S. Cl. ..... 220/5 R; 220/1 T; 220/74; 220/83; 206/505; 206/510; 206/519

[58] Field of Search ..... 220/5 R, 72, 74, 83, 220/94 A, 1 T; 206/505, 508, 519, 510

[56] References Cited

U.S. PATENT DOCUMENTS 3,811,597 5/1974 Frankenberg et al. ..... 220/94 A X 4,165,020 8/1979 Hoselton ..... 206/508 X 4,231,476 11/1980 Compton et al. ..... 206/519

4,364,477 12/1982 Stromberg ..... 220/94 A X

*Primary Examiner*—Steven M. Pollard

*Attorney, Agent, or Firm*—John F. A. Earley; John F. A. Earley, III

[57] ABSTRACT

A barrel for holding, handling, or storing large quantities of bulk material such as meat and other food products features a seamless, one-piece plastic construction with integrally formed recessed handles for lifting or moving the barrel and integrally formed gussets to strengthen the barrel, and with nesting stop surfaces for nesting empty barrels, and with stacking surfaces and a lid for stacking filled barrels.

10 Claims, 4 Drawing Figures

BARREL

BACKGROUND OF THE INVENTION

1. Field of the Invention

The present invention pertains to durable one-piece molded plastic liquid-tight barrels for holding, handling, or storing large quantities of bulk material such as meat and other food products. The barrels may be nested when empty and, when used with a lid, may be stacked when filled.

2. Description of the Prior Art

Prior art barrels of one-piece construction for holding, handling, and storing large quantities of bulk material such as meat and other food products have handles that protrude outwardly from the sides of the barrel. Such outwardly extending handles are typically either a pair of rectangular or similarly shaped handles that protrude from the side of the barrel or an outwardly extending rollover lip that functions as a handle. These handles may fail when the barrels are subjected to heavy loads or subjected to violent impacts such as when they are banged together or dropped to the ground. Prior art barrels therefore may become useless long before they reach the end of their useful life.

Another problem with the outwardly extending handles is that they cause the barrels to require more storage space than if the handles were not present because outwardly extending handles prevent the outside walls of adjacent barrels from being placed close together.

Other prior art barrels have handles that are almost flush with the barrel wall known as drop handles. These handles are typically made of metal and comprise two pieces: one piece being a plate that attaches to the outside wall of the barrel and the other piece being a handle that fits through a sleeve on the plate and can rotate up and down. This type of handle has several disadvantages. Drop handles require other assembly operations in addition to constructing the barrel. Further, drop handles may fail and break when subjected to heavy loads. Moreover, the metal of the handles can rust and corrode.

SUMMARY OF THE INVENTION

An object of this invention is to provide a durable barrel with recessed handles so that the barrel requires less storage space than barrels with outwardly extending handles.

Another object of this invention is to provide a durable barrel with recessed handles which are stronger and last longer than outwardly extending handles or drop handles.

Another object of this invention is to provide a durable barrel which is strengthened by gussets.

Another object of this invention is to provide a durable barrel which may be nested when empty and which, when used with a lid, may be stacked when full.

Another object of this invention is to provide such a barrel that is molded of plastic in seamless, one-piece construction.

DETAILED DESCRIPTION

Figure 1:
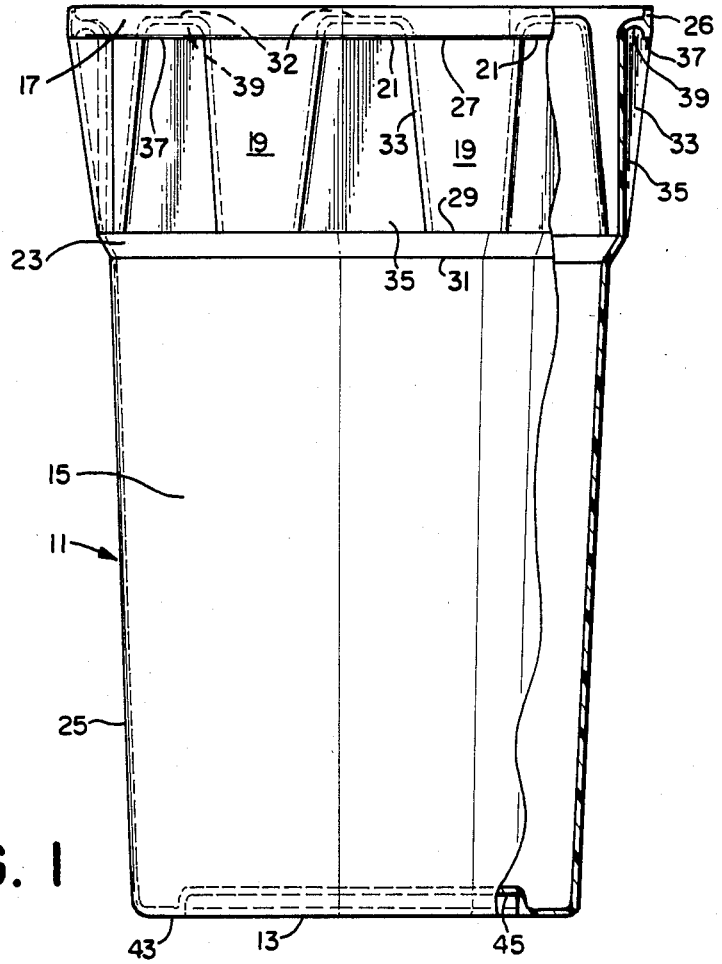
FIG. 1 is a side view in elevation of a barrel constructed in accordance with this invention.
Figure 2:
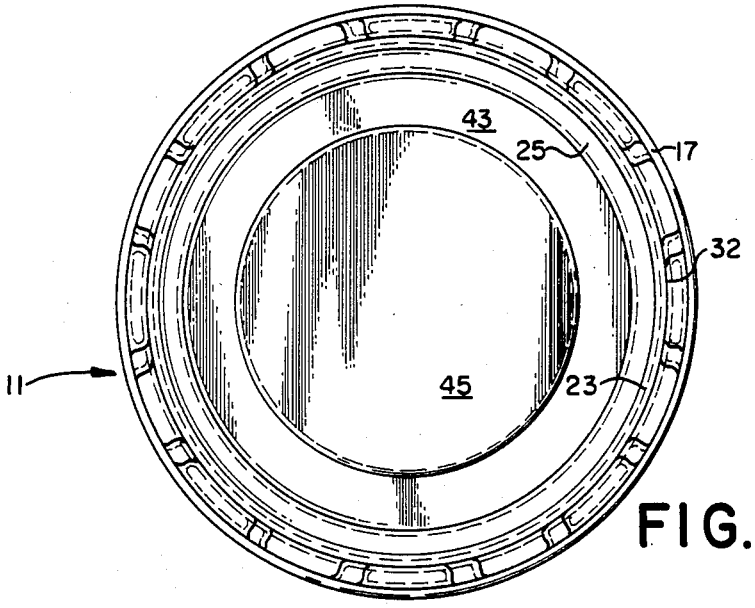
FIG. 2 is a top plan view of the barrel of FIG. 1.

Turning now to the drawings, there is shown a barrel 11 for holding, handling, and storing large quantities of bulk material such as meat and other food products, which comprises a durable one-piece molded plastic liquid-tight single wall barrel 11 having a bottom wall 13 and an upwardly extending cylindrical side wall 15, the walls being molded preferably of FDA-approved polyethylene plastic.

The term "plastic" is used herein in its most common sense to mean synthetic resins that are moldable into various forms and are hardened for commercial and industrial use.

The cylindrical side wall 15 comprises a rim 17, a plurality of alternating integrally formed gussets 19 and recessed handles 21, a stop shoulder 23 and a lower side wall 25.

The rim 17 extends circumferentially around the top of the barrel 11, and the sides 26 of the rim are vertical.

The plurality of gussets 19, eight being shown, are integrally formed in the cylindrical side wall 15 and provide strength and support for the rim 17 and the barrel 11. The gussets 19 extend downwardly from the bottom edge 27 of the rim 17 and slope inwardly from top to bottom, ending at the top border 29 of stop shoulder 23 making the outside circumference of the barrel 11 at the rim 17 greater than the outside circumference of the barrel 11 at the top border 29 of the stop shoulder 23.

The plurality of recessed handles 21, eight being shown, are integrally formed in the cylindrical side wall 15 of the barrel 11 and are designed to allow easy lifting, dumping, or tilting of the barrel 11 without breaking. Outwardly extending handles are weaker than the recessed handles 21 of this invention and may break when subjected to heavy loads. The recessed handles 21 are defined by a depression that extends in an upward direction from the top border 29 of the stop shoulder 23 to a point behind and just below the top of the rim 17 thereby forming recessed side walls 33, recessed back wall 35, and handle lip 37. The recessed back wall 35 of a recessed handle 21 taper from top to bottom so that the width of back wall 35 is narrower near the rim 17 and wider near the stop shoulder 23. The recessed side walls 33 also function as the side walls of the gussets 19 which are wider near the rim 17 and narrower near stop shoulder 23.

In a preferred embodiment of the invention there are eight recessed handles 21 alternating with eight gussets 19.

The stop shoulder 23 of the cylindrical side wall 15 provides means for nesting of a plurality of empty barrels 11 for storage or transportation. The stop shoulder 23 extends downwardly from a top border 29 and slopes inwardly from top to bottom until it reaches the lower side wall 25 which it meets to form a bottom border 31. The stop shoulder 23 of an upper nesting barrel nests against the inward projections 32 of the recessed handles 21 of a lower nesting barrel which function as nesting stops that prevent the upper nesting barrel from wedging or jamming in a lower nesting barrel. The recessed handles 21 project radially inwardly for a distance such that the inside diameter of the barrel 11 as measured from the farthest inward projections 32 of the recessed back walls 35 of opposing recessed handles 21 is greater than the outside diameter of the barrel 11 measured at the bottom border 31 of stop shoulder 23 and smaller than the outside diameter of the barrel 11 measured at the top border 29 of stop shoulder 23 thereby causing the inward projections 32 of the lower nesting barrel to support the stop shoulder 23 of an upper nesting barrel. The spaces between the inward projections 32 of the recessed handles 21 allow air to pass between nesting barrels so that a vacuum is not formed between barrels when nesting to make pulling them apart difficult.

The lower side wall 25 of the cylindrical side wall 15 of barrel 11 extends from the bottom border 31 of the stop shoulder 23 to the bottom wall 13, and slopes slightly inwardly from top to bottom.

The central portion of bottom wall 13 of barrel 11 is recessed so as to form a circumferential bottom ridge 43 and a recessed bottom wall 45. The circumferential bottom ridge 43 functions as a hand hold for easier gripping with the fingers and easier tilting so that the barrel may be grasped at the bottom by grasping ridge 43 and at the top by grasping a handle 21.

Figure 3:
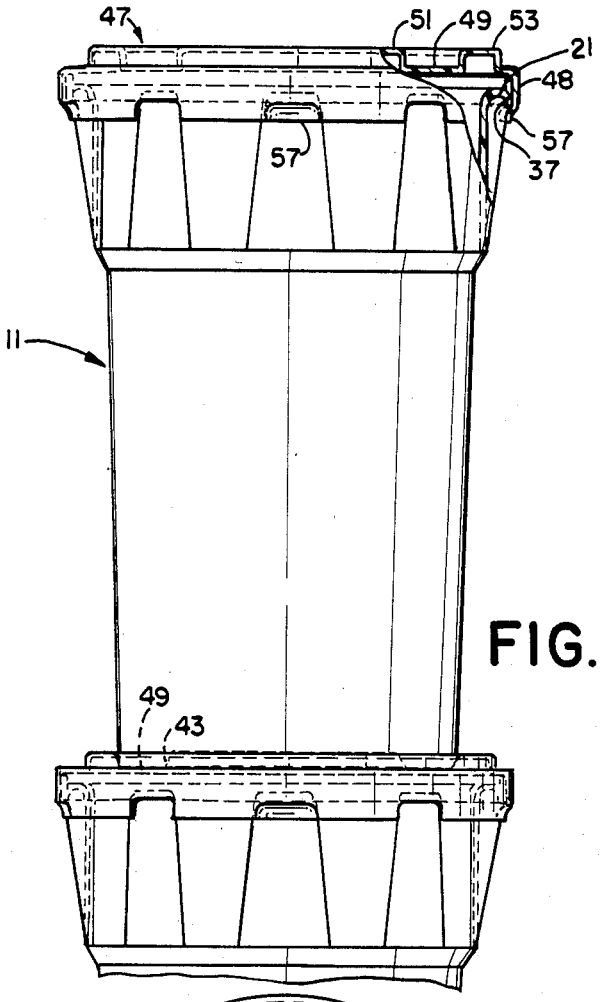
FIG. 3 is a side view in elevation showing two barrels in a stacked arrangement.
Figure 4:
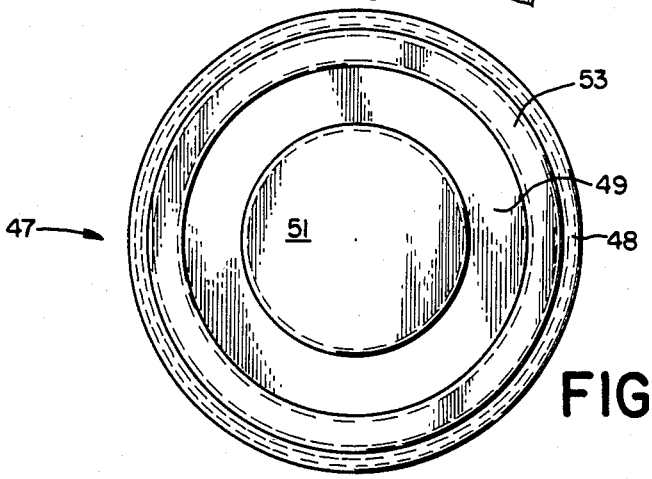
FIG. 4 is a top plan view of a stacking lid constructed in accordance with the invention.

Referring to FIGS. 3 and 4, barrel 11 has a stacking lid 47 for use when barrels are to be stacked one upon the other. Stacking lid 47 is of one-piece construction having a circumferential lid lip 48 and a circumferential channel 49 defined by a raised circular shaped center portion 51 and an outer annular lid ridge 53. The circumferential channel 49 of stacking lid 47 is of sufficient width to receive and seat the bottom ridge 43 of barrel 11 so that when barrels 11 are stacked one upon another, the seating of the upper barrel in the lower stacking lid prevents lateral movement of the upper barrel. The raised circular center portion 51 and outer annular lid ridge 53 of stacking lid 47 also strengthen the lid.

The lid lip 48 extends vertically downwardly from the stacking lid 47 to cover the rim 17. The stacking lid 47 is secured to the barrel 11 by a plurality of snaps 57 formed in the lid lip 48. The snaps depend from the lid lip 48 and curve radially inwardly for a distance approximately equal to the thickness of the barrel lip 17 and engage the handle lip 37 to provide a secure grip between the stacking lid 47 and the barrel 11. In a preferred embodiment of the invention, there are four such snaps 57, apaced 90° apart on the lid lip 48 to engage four handle lips 37 of the barrel 11. The four remaining unengaged handle lips are used for handling the lid covered barrel, and the portions of the lip 48 of the stacking lid 47 that are aligned with the unengaged handle lips 37 are cut away so that the lid lip 48 does not obstruct the recessed handle 21.

In operation, a barrel 11 is lifted or handled by inserting your fingers under the handle lip 37 and into the groove 39 of the recessed handles 21 and then carrying out the desired operation. If a barrel is to be tipped or dumped, the circumferential bottom ridge 43 of the barrel provides a bottom hand hold.

A stacking lid 47 is secured to a barrel by aligning and then engaging the snaps 57 of the stacking lid 47 with the handle lips 37 of the recessed handles 21. Barrels are stacked by placing an upper barrel on top of the stacking lid 47 of a lower barrel so that the circumferential channel 49 of the stacking lid of the lower barrel receives and seats the bottom ridge 43 of the upper barrel. Empty barrels are nested simply by placing an upper empty barrel into an empty lower barrel.

I claim:

1. A barrel for handling large quantities of bulk material such as meat and other food products, comprising a molded plastic barrel having a bottom wall and a cylindrical side wall extending upwardly from the bottom wall, a rim extending circumferentially around the top of the cylindrical side wall, nesting stop means formed near the top of the side wall and flaring outwardly for facilitating nesting and unnesting of the barrel in a similar barrel by limiting the distance an upper nesting barrel extends into a lower nesting barrel, rim support means integrally formed in the top portion of the barrel side wall and extending from the rim of said barrel to the top of the nesting stop means for strengthening and supporting the rim and the barrel, said rim support means sloping outwardly from the stop means to the rim, recessed handle means integrally formed between the rim support means for providing handles for an operator handling the barrel, and inward projections of the recessed handle means extending inside the barrel adapted to support the nesting stop means of an upper barrel nested in a lower barrel and providing spaces between said inward projections to allow air to pass between nesting barrels so that a vacuum is not formed between nesting barrels to make pulling them apart difficult.

2. The barrel of claim 1, said rim support means for supporting the rim being a plurality of gussets integrally formed in the top portion of the barrel and extending from the rim to the top of the nesting stop means and slanting outwardly and upwardly from the side wall.

3. The barrel of claim 1, said recessed handle means being a plurality of depressions integrally formed in the barrel that extend from the top of the nesting stop means to behind the rim and above the bottom of the rim to form grooves and handle lips for ease of gripping and handling of the barrel.

4. The barrel of claim 1, said nesting means including a circumferential stop shoulder located at a point below the rim support means and recessed handle means, said top shoulder flaring inwardly from top to bottom, whereby with an upper barrel placed in a lower barrel the circumferential stop shoulder of the upper barrel engages and rests against the inward projections of the recessed handle means of the lower barrel.

5. The barrel of claim 1, said barrel being made of FDA-approved polyethylene.

6. The barrel of claim 1, said barrel being of seamless construction.

7. The barrel of claim 1, said bottom having a recess so as to form a circumferential bottom grasping ridge for utility in tipping and dumping of the barrel and for engaging a stacking lid.

8. The barrel of claim 7, having a stacking lid with a circumferential channel for engaging the circumferential bottom ridge of another barrel.

9. The barrel of claim 8, said stacking lid having securing means to attach the stacking lid to the barrel, the securing means being snaps which depend from the stacking lid and engage the handle lip of the recessed handle means.

10. A barrel for handling large quantities of bulk material such as meat and other food products, comprising a molded plastic barrel having a bottom wall and a cylindrical side wall extending upwardly from the bottom wall, a rim extending circumferentially around the top of the cylindrical side wall, nesting stop means formed near the top of the side wall and flaring outwardly for facilitating nesting and unnesting of the barrel in a similar barrel by limiting the distance an upper nesting barrel extends into a lower nesting barrel, rim support means integrally formed in the top portion of the barrel side wall and extending from the rim of said barrel to the top of the nesting stop means for strengthening and supporting the rim and the barrel, said rim support means sloping outwardly from the stop means to the rim, recessed handle means integrally formed between the rim support means for providing handles for an operator handling the barrel, and inward projections of the recessed handle means extending inside the barrel adapted to support the nesting stop means of an upper barrel nested in a lower barrel and providing spaces between said inward projections to allow air to pass between nesting barrels so that a vacuum is not formed between nesting barrels to make pulling them apart difficult, said rim support means for supporting the rim being a plurality of gussets integrally formed in the top portion of the barrel and extending from the rim to the top of the nesting stop means and slanting outwardly and upwardly from the side wall, said recessed handle means being a plurality of depressions integrally formed in the barrel that extend from the top of the nesting stop means to behind the rim and above the bottom of the rim to form grooves and handle lips for ease of gripping and handling of the barrel, said nesting means including a circumferential stop shoulder located at a point below the rim support means and recessed handle means, said top shoulder flaring inwardly from top to bottom, whereby with an upper barrel placed in a lower barrel the circumferential stop shoulder of the upper barrel engages and rests against the inward projections of the recessed handle means of the lower barrel, said barrel being made of FDA-approved polyethylene, said barrel being of seamless construction, said bottom having a recess so as to form a circumferential bottom grasping ridge for utility in tipping and dumping of the barrel and for engaging a stacking lid, having a stacking lid with a circumferential channel for engaging the circumferential bottom ridge of another barrel, and said stacking lid having securing means to attach the stacking lid to the barrel, the securing means being snaps which depend from the stacking lid and engage the handle lip of the recessed handle means.

* * * * *